US006039150A

United States Patent [19]

Palmer

[11] Patent Number: 6,039,150

[45] Date of Patent: Mar. 21, 2000

[54] BUILDING GUARD RAIL SCAFFOLD ASSEMBLY

[76] Inventor: Theodore R. Palmer, Unit #5 10 Pinelands Ave., Stoney Creek, Ontario, Canada, L8E 3A5

[21] Appl. No.: 08/837,211

[22] Filed: Apr. 22, 1997

Related U.S. Application Data

[63] Continuation-in-part of application No. 08/433,064, May 3, 1995, abandoned.

[51] Int. Cl.[7] ..... A47L 3/02

[52] U.S. Cl. ..... 182/113; 182/82; 256/DIG. 6

[58] Field of Search ..... 182/45, 82, 113, 182/150; 248/235, 237; 256/59, DIG. 6

[56] References Cited

U.S. PATENT DOCUMENTS

| | | | |
|---|---|---|---|
| 3,480,257 | 11/1969 | Bourn et al. | 182/113 X |
| 3,595,510 | 7/1971 | Hutchinson | 182/113 X |
| 3,867,997 | 2/1975 | Hyslop, Jr. | 182/113 |
| 4,078,633 | 3/1978 | Fahy | 182/82 |
| 4,453,619 | 6/1984 | Bierman | 182/150 X |
| 4,558,764 | 12/1985 | Lorenz | 182/45 |
| 4,666,131 | 5/1987 | Kettelkamp, Sr. et al. | 182/113 X |
| 4,669,577 | 6/1987 | Werner | 182/113 |
| 4,673,060 | 6/1987 | Gregory | 182/113 X |
| 4,676,341 | 6/1987 | Shaffstall | 182/45 |
| 4,909,483 | 3/1990 | Van Herpen | 256/59 |
| 4,957,185 | 9/1990 | Courchesne et al. | 182/150 |
| 5,029,670 | 7/1991 | Whitmer | 182/113 |
| 5,067,586 | 11/1991 | Myers | 182/113 X |
| 5,145,153 | 9/1992 | Glynn | 256/59 |
| 5,377,958 | 1/1995 | Palmer | 256/59 |
| 5,464,070 | 11/1995 | Griek et al. | 182/113 X |
| 5,515,941 | 5/1996 | Palmer et al. | 182/45 |
| 5,570,559 | 11/1996 | Lewis | 256/DIG. 6 X |
| 5,638,917 | 6/1997 | Vennen | 182/150 |
| 5,718,305 | 2/1998 | Palmer | 182/45 |
| 5,829,549 | 11/1998 | Flynn | 182/82 |

*Primary Examiner*—Daniel P. Stodola
*Assistant Examiner*—Richard M. Smith
*Attorney, Agent, or Firm*—McConnell and Fox

[57] ABSTRACT

A guard rail scaffold assembly comprises a plurality of assembly members carrying horizontally extending guard rails. Each assembly member comprises an elongated base member attachable by a releasable connector to a fastener pad fastened to an above-ground structure surface. The connector allows pivoting movement of the base member for adjustment of the base member to be parallel to the surface. The base member also carries surface engaging members on opposite sides of the connector which engage the structure surface to maintain the base member parallel to the structure surface. A first post member extends from the base member and, when the scaffold is mounted on the guarded surface, this constitutes a guard rail support member or has a guard rail support member mounted thereon. When the scaffold is mounted on a wall surface a second post member is releasibly mounted on the first post member and receives the guard rail support member instead of the first post member. The assembly can thus be fastened either to a horizontal or a vertical surface, or both, although each assembly member is fastened either to a horizontal or to a vertical surface, but not both. Forces applied to the guard rails are converted by the guard rail support members to force moments at one or other of the surface engaging members urging the base member to rotate about these areas, so that tension forces applied to the fastener pads are maximized and peeling forces are minimized.

23 Claims, 4 Drawing Sheets

BUILDING GUARD RAIL SCAFFOLD ASSEMBLY

CROSS-REFERENCE TO RELATED APPLICATION

This application is a continuation-in-part of my prior application Ser. No. 08/433,064, filed May 3, 1995, now abandoned.

FIELD OF THE INVENTION

This invention provides a new guard rail scaffold assembly for mounting on or around an above-ground surface of a building or structure on which persons are working to guard against them falling therefrom. The invention also provides a new scaffold assembly member for such a scaffold assembly.

REVIEW OF THE PRIOR ART

It is an increasing requirement when persons are required to work on above-ground surfaces of buildings and structures, for example for the purpose of repair and maintenance, to provide against the possibility of accidental falls to the ground below. Since a fall of quite a short distance can cause serious injury, or even death, the provision of such guard means is desirable when the height above ground of the surface, usually a roof surface of some kind, is as small as about 2 meters (6 feet), and some jurisdictions now require a safety installation for all operations on surfaces above this height. The installation can, for example, comprise a safety harness for each worker that is attached to a respective secure point on the structure, but such harnesses are awkward to install and maintain, and are a considerable hindrance to movement around the structure, especially when more than one worker is employed. Increasingly therefore the preferred safety installation is a guard rail of about waist height that encloses the working area and permits the workers to move freely within it.

It is common in all phases of construction and repair of buildings and other structures to use various forms of safety scaffold directly mounted on the ground. However. attachment to the structure is to be preferred, since direct support from the ground usually requires a substantial construction to raise the guard rails high enough, adding considerably to the cost and time taken in completing the job. It has been proposed in the past to support such a scaffold directly from a building roof using brackets attached to the roof, a typical example of such a structure being that shown in U.S. Pat. No. 1,558,425, the brackets being spiked to the roof with the scaffold pinned onto the brackets in amanner such as to adapt to various roof pitches. Alternative arrangements are illustrated in U.S. Pat. Nos. 3,158,223 and 4,074,792, in both of which the supports are not attached to the roof but maintain their position by frictional engagement with the roof.

The principal requirement of such a scaffold assembly is that it, and its fastenings to the structure, are able to withstand the outward-acting impact force of at least one (and perhaps two) workers falling against it, and to this end it is usual, if at all possible, to attach the assembly to the roof surface employing metal fastenings positioned and arranged for the resultant force to be applied to them in shear, so that the rentention strength of the fastenings is maximized. An example of such a structure is shown in U.S. Pat. No. 5,515,941, issued May 14, 1996 to Theodore R. Palmer et al, comprising a guard structure for installation at the edge of a building roof eave, the structure employing a plurality of transversely spaced thin flat roof cleats that are nailed to the upwardly sloping roof surface. Each cleat is hinged to a support member that extends principally above and only a small amount below the eave or roof line, the part of the support member above the eave linesupporting a toe board, a catch board and horizontally extending guard rails, while the part below the eave line engages the adjacent side wall of the building structure through a pressure plate. This engagement of the guard structure with both roof and wall surfaces ensures that the fastening nails are subjected almost entirely to sideways acting shear forces and to a corresponding minimum of tension forces tending to pull them out of the roof surface.

The wide variety of building structures encountered make it very difficult to provide a single guard rail scaffold structure usable with the largest possible number of them. There are also a large number of structures which were built before any such regulation was even contemplated, and it is now difficult and expensive to provide the required safety structure using known systems. It is preferred whenever possible to fasten the guard scaffold structure to the surface on which the workers move, especially when this is flat and horizontal, but this often is inconvenient, or even impossible, for example because of the type of roof construction, because of the presence of a raised edge at the wall/roof junction, because of other structures on the roof, or because the surface is too higly sloped. Moreover, it is usually found to be very difficult, if not impossible, to fasten a guard rail scaffold assembly at the wall/roof junction so as to take advantage of its engagement with both surfaces in ensuring secure fastening, and instead almost always it is found that it can only conveniently be fastened either only to the roof surface or only to the side wall, but not to both.

Many structures, for example high power electric transformers, are of metal so that it is not possible to use nails for attaching and maintaining a scaffold in position, and welding or bolting, besides being relatively expensive, are usually not possible or desirable. The friction between the scaffold supports and the metal structure surfaces would be too low and/or uncertain for safety without some means for positive attachment. Increasingly it is found that with appropriate application procedures it is possible to use high strength adhesives to fasten structures to walls and roofs, but the design of appropriate attachment structures using such adhesives has proven difficult, and in particular attachment structures that place their fastenings in shear are unsatisfactory. Thus, any attachment structure using an adhesive comprises essentially two parallel surfaces respectively on the building structure and on the attached structure with a thin layer of the adhesive between them. Adhesives exhibit maximum retentive strength to tension forces that act perpendicular to the adhered surfaces to pull them apart, and much reduced strength to forces acting parallel to the surfaces and tending to peel them apart.

SUMMARY OF THE INVENTION

It is a principal object of the invention to provide a new guard rail scaffold assembly comprising guard rail assembly members fastened on or around a structure surface to be guarded with which forces applied to the fastenings between the guard rail assembly members and the structure are as much as possible applied as tension forces and not peeling forces.

It is another principal object to provide a new guard rail assembly member for such scaffold assemblies which is fastened either solely to the guarded structure surface, or solely to a wall surface, at the dictate of the type of structure and/or the choice of the installer.

It is a further object to provide such a new guard rail scaffold assembly, and a new guard rail scaffold assembly member therefor, that are simple and inexpensive to manufacture and to install, assisting in ensuring they will be used, especially with small jobs where cost may be a prime consideration.

It is a further object to provide such a new guard rail scaffold assembly, and a new guard rail scaffold assembly member therefor comprising structure surface attachment parts that can be left permanently on the structure surface, so that they can be reused whenever the assembly is re-installed.

In accordance with the invention there is provided a guard rail scaffold assembly mounted around an above ground structure surface to be guarded so as to protect an operator on the guarded surface against falling therefrom;

wherein:

the scaffold assembly comprises a plurality of transversely spaced vertically extending guard rail assembly members, a plurality of elongated horizontally extending guard rails each extending between and supported by a respective pair of immediately adjacent guard rail assembly members, and a plurality of fastener pads, one for each guard rail assembly member, each fastener pad comprising a respective pad separable connector part and being fastened to a fastener engagement area of a surface of the structure selected from a wall surface thereof and the guarded surface;

wherein:

each guard rail assembly member comprises an elongated base member comprising a base member separable connector part cooperatively engaged with a respective pad separable connector part to form therewith a pivotable separable connector having a pivot axis that extends horizontal and parallel to the structure surface, the base member being pivotable about the pivot axis for adjustment of its direction of elongation so that the said direction can be made to extend at least approximately parallel to the fastener engagement area;

each guard rail assembly member also comprises a guard rail support member connected to the base member so as to extend above the guarded surface, the guard rail support member having at least one guard rail retainer member receiving a respective horizontally extending guard rail to retain it at a required distance above the guarded surface; and each guard rail assembly member further comprises two wall surface engaging members on the base member, both spaced from the pivot axis on opposite sides thereof and engaging respective correspondingly spaced engagement areas of the same selected structure surface, to thereby maintain the direction of elongation of the base member parallel to the fastener engagement area;

wherein:

the last-mentioned engagement areas also constitute respective pivot areas about which the base member is urged to pivot when it is subjected to a force acting respectively outward away from or inward toward the wall surface;

wherein:

an outward acting force applied to a guard rail urges the base member for pivoting movement at the corresponding pivot area away from the selected structure surface, thereby producing a corresponding pivoting force moment at the respective pivot area, and an inward acting force urges the base member for pivoting movement at the other corresponding pivot area away from the structure surface, thereby producing a corresponding pivoting force moment at the respective pivot area;

and wherein:

the force that is applied to the pivotal separable connector as the result of an inward or an outward force is thereby applied thereto as a maximum of tension force acting outward at least approximately perpendicularly to the fastener engagement area and as a minimum of peeling force acting parallel to the fastener engagement area.

In such an assembly each fastener pad may be fastened to a fastener engagement area of a wall surface of the structure, one of the two wall surface engaging members on the base member being disposed below the pivot axis and engaging a respective lower engagement area of the same wall surface, the other wall surface engaging member being disposed above the pivot axis and engaging a respective upper engagement area of the same wall surface, the lower and upper engagement areas also constituting respective lower and upper pivot areas about which the base member is urged to pivot.

Alternatively, in such an assembly each fastener pad may be fastened to a fastener engagement area of a guarded surface of the structure, one of the two guarded surface engaging members on the base member engaging a respective nearer engagement area of the same guarded surface, and the other engaging a respective further engagement area of the same above ground surface, the nearer and further engagement areas also constituting respective nearer and further pivot areas about which the base member is urged to pivot.

Further in accordance with the invention there is provided a new guard rail assembly member for mounting such a guard rail scaffold assembly on or around an above ground surface to be guarded.

DESCRIPTION OF THE DRAWINGS

Guard rail scaffold assemblies and guard rail assembly members that are particular preferred embodiments of the invention will now be described, by way of example, with reference to the accompanying diagrammatic drawings, wherein.

For convenience similar or equivalent parts are given the same reference number in all the Figures of the drawings wherever that is possible.

DESCRIPTION OF THE PREFERRED EMBODIMENTS

Figure 1:
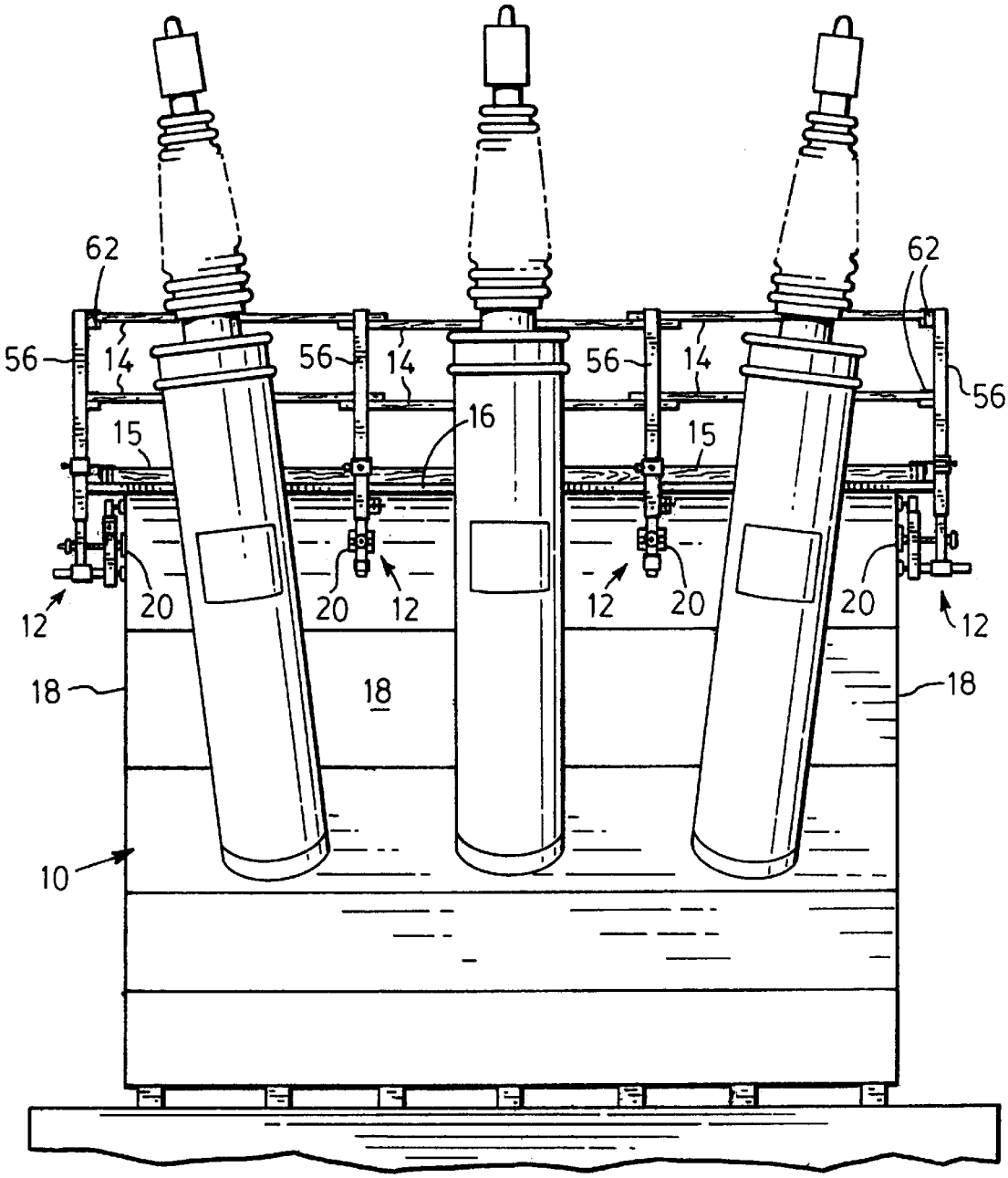
FIG. 1 is a front elevation of a high power electric transformer showing a guard rail scaffold structure assembly of the invention mounted around the protruding edge of its horizontal top surface.

FIG. 1 shows in front elevation a typical high power electric transformer 10 of a size such that maintenance personnel can move about on its top surface, that surface being considerably higher than 2 meters (6 feet) above the surrounding ground. For clarity in illustration the guarded top surface is shown as being relatively flat while various ancillary structures that normally are mounted thereon are not shown; because of the presence of these ancillary structures, and the need for the guard rail scaffold assembly to enclose the entire top surface, it is usually found to be most satisfactory to attach the guard rail assembly members to the transformer side walls.

Typically a guard rail scaffold assembly of the invention comprises a plurality of guard rail assembly members 12, these members supporting between them a plurality of horizontally extending guard rails 14, and also supporting a plurality of horizontally extending toe boards 15 mounted around the protruding edge of the horizontal top surface 16 to be guarded. The members 12 are fastened solely to the vertical side walls 18 of the transformer, as will be described below.

Figure 2:
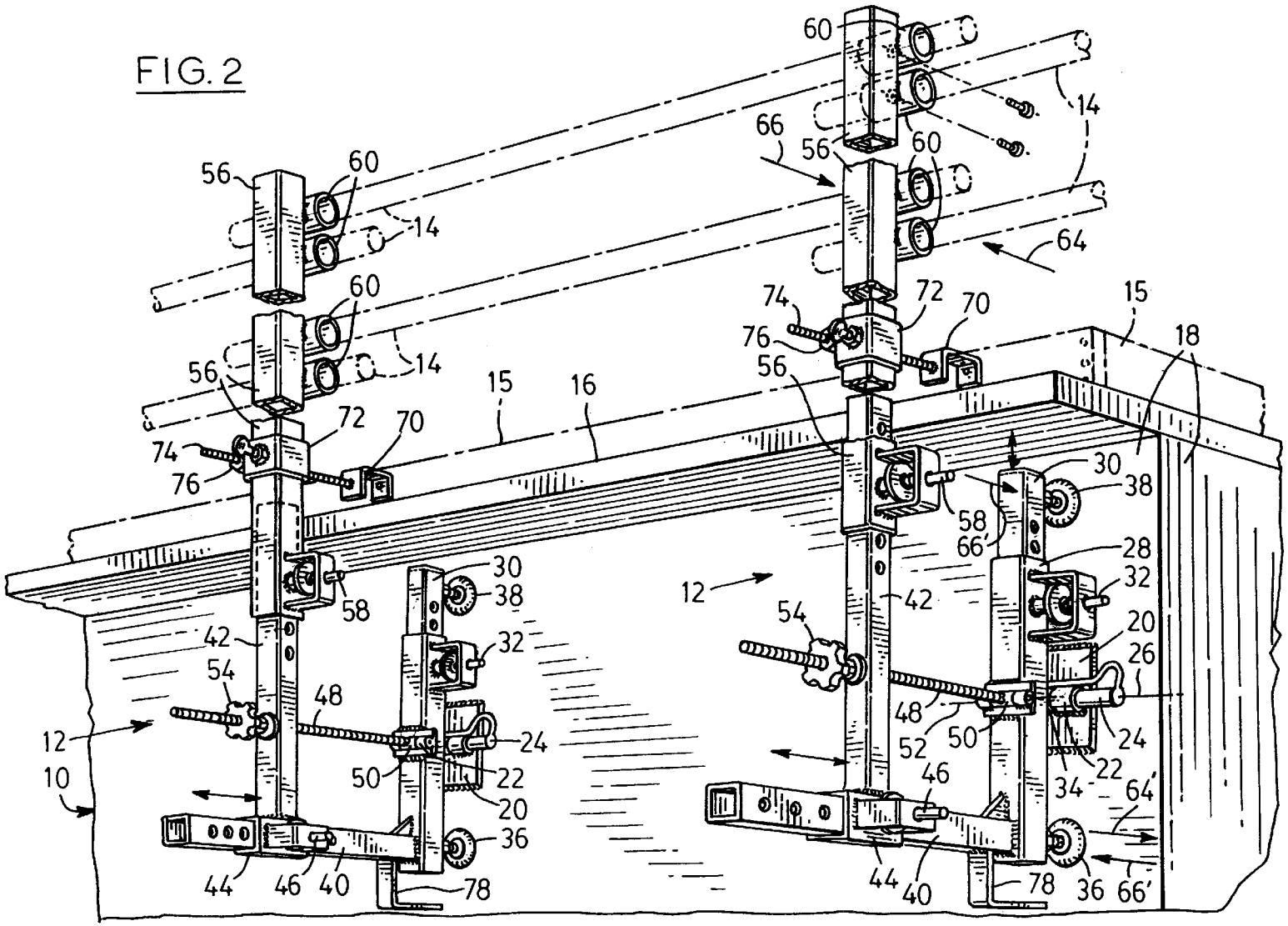
FIG. 2 is a perspective view from below and to one side, showing to a larger scale than FIG. 1 the manner in which a guard rail scaffold assembly of the invention typically is mounted around the protruding edge of a horizontal roof surface by attachment of the guard rail assembly members solely to vertical wall surfaces of the structure.

Referring now also to FIG. 2, the first step in assembling the scaffold structure is to attach a plurality of horizontally spaced fastener pads 20 to the side walls 18, each pad comprising a flat rectangular metal plate. The preferred method of fastening these pads to the side walls, especially in the case of electric transformers, is by means of a suitable high strength adhesive, such as that sold by Loctite Corporation, Rocky Hill, Conn. as "LOCTITE 330". In most instances the guard rail structure is only required for short periods at long and/or infrequent intervals, and the pads are sufficiently inexpensive that, once attached to the structure, it is more economical to leave them in place while the remainder of the structure is removed for use at another site, resulting in considerable economies in their use. In the case of a wooden structure, and of a metal structure when appropriate and possible, the attachment can be by means of bolts or lag screws; however it is essential, as will become apparent from the description below, that the type of fastening then used is capable of withstanding the tension forces that are likely to be applied to them, and cannot employ their shear strength for their retentive power.

Each fastener pad is attached to the surface of the wall 18 at a respective fastener engagement area, and is provided with two horizontally spaced coaxial separable connector parts 22 snugly receiving a removable connector pin 24 held therein by a spring retainer. The connector pin also serves as a hinge pin, as will be described below, the resulting hinge having a pivot axis 26 that is horizontal and extends at least approximately parallel to the surface of the wall 18. With a cylindrical structure the axis will still be horizontal, and will be tangential to the fastener engagement area.

Each guard rail assembly member comprises a respective elongated base member 28, which in this embodiment comprises a length of square cross section hollow metal tube, in which is telescopically mounted a base member extension member 30, also a length of square cross section hollow metal tube. One side of the member 30 is provided with a plurality of longitudinally spaced latch holes into any selected one of which a spring urged latch 32 can be engaged to fix the overall length of the combined base member. The base member surface that faces the wall surface 18 when the member 12 is installed has mounted thereon a connector part 34 which is engaged snugly between the pad connector parts 22 and receives the connector pin 24 to complete the resulting pivotable separable connector. The hinging provided by the pivotable connector permits the base mounted member to be rotated about the pivot until its direction of elongation is as parallel as possible to the plane of the fastener engagement area, when it will also extend at least approximately vertical. At any time the members 12 and their attachments can be removed from the structure by simple removal of the connector pins, leaving the fastener pads 20 in place.

The surface of the base member carrying the connector part 34, and the corresponding surface of the extension member 30, are provided at their respective free ends with respective wall surface engaging members 36 and 38 spaced vertically from the pivot axis 26 on opposite sides thereof, and for convenience in reference referred to herein respectively as the lower and upper wall surface engaging members. Each of the members 36 and 38 is mounted on a screw threaded shaft engaged in a nut welded to the respective member 28 and 30, so that rotation thereof in the required direction permits adjustment of the length of their extension from the respective base member until the base member direction of elongation is parallel and vertical, as described above. The lower and upper wall surface engaging members 36 and 38 engage the wall surface respectively at corresponding lower and upper engagement areas.

Each guard rail assembly member also comprises a first elongated post member 40 of square cross section hollow metal tube fastened, as for example by welding, to the surface of the base member opposite to that to which the adjacent lower surface engaging member 36 is fastened, and immediately adjacent thereto, so that the direction of elongation of the post member lies at least approximately along the longitudinal axis of the screw threaded rod of the member 36. The direction of elongation of the post member extends at least approximately at a right angle to the direction of elongation of the base member, so that when the assembly member 12 is installed the post member extends correspondingly at least approximately horizontally and perpendicularly out from the vertical wall surface 18. In this embodiment a second elongated post member 42, also of square cross section hollow metal tube, is adjustably mounted on the first post member 40, being fixed to a sleeve 44 that slides freely but with little play on the first post member. The sleeve and second post member are retained in the required position along the first post member by a spring urged latch 46 that is engaged in the selected one of a plurality of longitudinally spaced latch holes in the first post member. The direction of elongation of the second post member extends at least approximately at a right angle to that of the first post member, and therefore extends at least approximately parallel to that of the base member 28 and, when the assembly is installed, vertically and parallel to the wall surface 18. Moreover, as will be seen in the drawing, the directions of elongation of the base member 28, the first post member 40 and the second post member 42 all lie in a flat common plane perpendicular to the guided surface 16.

There is inevitiably some play between the sleeve 44 and the first post member 40 and it is found advantageous to provide an adjustable length retainer member between the base member and the second post member, and in this embodiment this comprises a screw threaded rod 48 that extends between them. The rod is connected by a pivot 50 to the base member and extends through registering holes in the walls of the second post member. The pivot 50 is positioned on the base member directly opposite to the base member pivot axis 26, on the opposite side thereto, the horizontal pivot axis 52 of the pivot 50 extending parallel to the pivot axis 26, while the end of the member 48 that protrudes from the second post member is provided with a hand and wrench operable adjusting nut 54 that in operation buts against the second post member.

Each guard rail assembly member 12 further comprises a respective elongated guard rail support member 56, also of square cross section hollow metal tube, that in this embodiment is connected to and supported by the base member 20 via both of the first and second post members, the support member 56 being releasibly and telescopically mounted on the second post member 42, employing a spring urged latch 58 engagable in the selected one of a plurality of longitudinally spaced holes in the second post member. Such a mounting permits ready adjustment of the height which the support member extends above the surface 16 to be guarded, so that the uppermost guard rails 14 supported thereby are at the required minimum height, as usually specified by a building code. The direction of elongation of the support member 56 also lies in the same flat perpendicular plane as those of the base member 28 and the first and second post members 40 and 42, as described above. The guard rails are supported by two a vertically spaced pairs of guard rail retainer members 60 at the upper portion of each support member. This embodiment is intended for use with guard rails 14 comprising lengths of round metal tube, and accordingly the retainer members are short sections of round metal tube welded to the member 56 and of such diameter as to snugly receive a guard rail section 14 pushed endwise therethrough. The retainer member tube sections of each pair are closely adjacent, so that they can receive the adjacent ends of two tubular guard member sections with their ends overlapped. The tubular guard rails of two adjacent side walls are joined at their junctions by suitable end connectors 62 (FIG. 1). It is a requirement of a number of scaffold safety codes to provide at least two vertically spaced guard rails with a maximum distance between them, and the use of less than two is unlikely, while more than two can of course be provided.

It is also a requirement of a number of scaffold safety codes to provide toe boards 15 at the level of the guarded surface 16 around the perimeter of the enclosed space, especially when there is a vertical drop at the edge, to prevent, or at least reduce the possibility that tools, etc. lying on the surface are not accidentally knocked over the edge. In this embodiment these toe boards are retained in position by inverted-U shaped brackets 70 mounted on sleeves 72 that slide vertically on the members 56, being retained in position by a clamp screw. Each bracket 70 is connected to its sleeve 72 by a screw-threaded rod 74 engaged in a nut 76 fastened to the sleeve, so as to permit positioning of the toe boards at suitable locations close to the roof surface edges. The jaw provided by the bracket is wide enough to receive two boards face to face, so that they can be overlapped at the junction between them, as with the guard rails 14.

Once all of the mounting pads 20 are securely in place the base members 28 are attched thereto using the connector pins 24. The surface engaging members 36 and 38 are adjusted in length, as described above, until both are in firm contact with the wall surface engagement areas, and with the base member 28 vertical and parallel to the fastener engagement area. The guard rail support members 56 are slid onto their respective second post members 42 and latched in place to extend the required amount above the roof surface 16. The second post members are then slid on their respective first post members 40, ensuring that the connector rods 48 protrude through their respective apertures, until the support members 56 but against the protruding edge of the roof surface 16. The latches 46 are engaged in the appropriate apertures in the first post members and the nuts 54 of the retainer members tightened until the support members 56 but as tightly as possible against the roof edge. The guard rails 14 are put in place, the positions of the toe board brackets 70 are adjusted as necessary, and the toe boards 15 put in place. The roof surface is now secure for work to commence thereon.

The most likely scenario is that one or more persons on the roof surface will impact with forcible body contact against a guard rail as the rail restrains them from falling from the roof surface, producing an outward acting force on the rail. There is a much more remote possibility of an inward acting force being applied to any of the guard rails. Any outward force against the guard rails 14, such as is indicated by arrow 64 in FIG. 2, causes the application of an anti-clockwise force moment acting on the lower surface engaging members 36 to press them even more strongly into contact with their respective lower engagement areas, as indicated by arrow 64'. These lower engagement areas therefore also constitute respective lower pivot areas at which the base members 28 will be urged by the outward-acting force to pivot anti-clockwise outward away from the wall surface, but are restrained against such rotation by the separable connectors. The corresponding forces applied to the fastener pads 20 are therefore predominantly tension forces acting outward perpendicular to the wall surface and to the respective fastener engagement areas, attempting to pull the fastener pads 20 directly outward away from the surface 18, with the unwanted peeling components of these forces parallel to the planes of the fastener engagement areas minimized. The desired maximization of tension forces and minimization of peeling forces is facilitated by the installer ensuring that the elongated base members are installed so as to be as parallel as possible to the respective pad fastener areas.

In the absence of an overhanging edge to the top surface 16 any inward force applied to the guard rails 14, as indicated by arrow 66, causes the application a clockwise force moment acting on the surface engaging members 38 to press them even more strongly into contact with the respective upper engagement areas, as indicated by arrow 66'. These upper engagement areas therefore also constitute respective upper pivot areas at which the base members 28 will be urged by the applied outward-acting forces to pivot clockwise outward away from the wall surface, but are restrained against such rotation by the separable connectors. The corresponding forces applied to the fastener pads 20 are therefore again predominantly tension forces acting outward perpendicular to the wall surface and to the respective fastener engagement areas, attempting to pull the fastener pads 20 directly outward away from the surface 18, with the unwanted peeling components of these forces parallel to the planes of the fastener engagement areas minimized.

When an overhanging edge is present, as shown in FIG. 2, the effect of any outward acting force against the guard rails is unchanged but with an inward acting force the butting junctions between the support members 56 and the roof edge serve as respective pivot areas for the assemblies about which they are urged to rotate clockwise. Nevertheless, the result is to apply a force moment to the surface engaging members 38 with tension forces attempting to pull the surface engaging members 36 and the fastener pads 20 away from the wall surface 18, so that once again the forces applied to the fastener pads are predominantly tension forces with peeling forces minimized. Although in this embodiment the first post member 40 is attached to the base member 28 so as to be on the same side of the pivot axis 26 as the lower surface engaging member 36, it is equally possible for it to be attached on the same side as the upper surface engaging member 38, and the beneficial effect of the invention of the minimization of peeling forces applied to the fastener pads 20 will still be obtained. The guard structure is easily disassembled by successively removing the guard rails 14, the toe boards 15, the support members 56, and the connector pins 24, the remainder of each assembly 12 being removable as a unit. As with its assembly, because of the relatively small and convenient size of its parts, they are easily handled and stored.

In a particular preferred embodiment the fastener pads 20 are of mild steel of 6.25 mm thickness (0.25 in), are 10 cm (4 in) in length and are 7.5 cm (3 in) wide. The base member 28, the sleeve 44, and the guard rail support member 56 are of H.S.S. seamless square cross section steel tube of exterior side 3.75 cm (1.5 ins), while the first and second posts and the base member extension 30 are of the same type of tube of exterior side 3.125 cm (1.25 in), the smaller tube being a close sliding fit within the larger tube. The length of the base member 28 is 30.6 cm (12.25 ins), that of the extension member 30 is 15 cm (6 in), that of the first post is 25 cm (10 ins), and that of the second post is 40 cm (16 ins). The length of the support member 56 is 106 cm (42 ins), while the distance between the two sets of guard rail support members 60 is 40 cm (16 ins). Although in all of the embodiments shown herein the guard rail assembly members are fabricated from square cross section tube, they can also be made from round cross section tube, which is usually less expensive. Round cross section tubes are not inherently constrained against relative rotation, as with square cross section tubes; suitable constraint will be provided by the latches 32, 46 and 58, but additional locking pins to prevent such rotation may be required.

Figure 3:
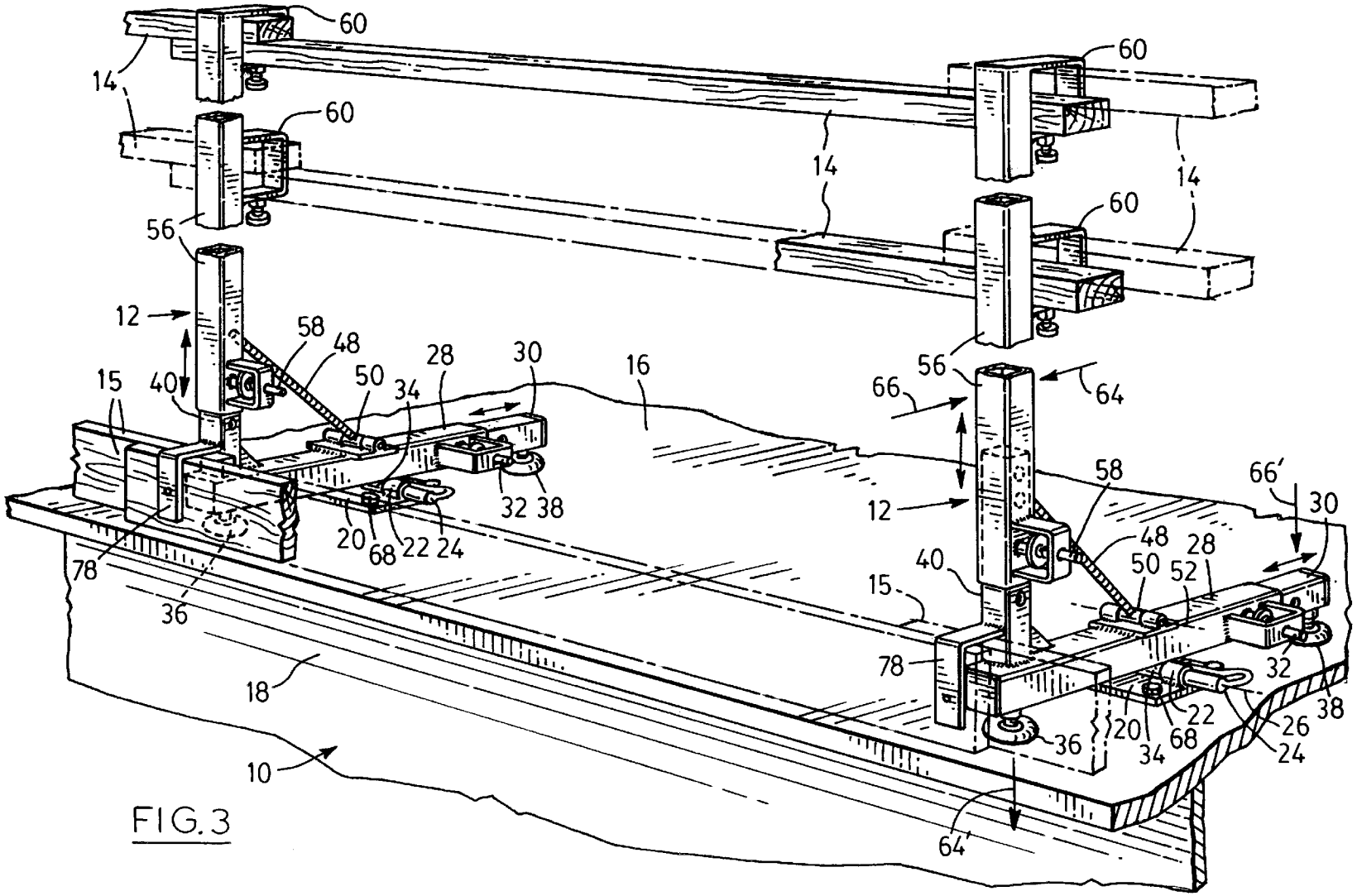
FIG. 3 is a perspective view from above to the same scale as FIG. 2 showing the manner in which a guard rail scaffold assembly of the invention typically is mounted adjacent the edge of a horizontal roof surface by attachment of the guard rail assembly members solely to the horizontal roof surface.

The embodiment of FIG. 3 illustrates the application of the scaffold assembly of the invention to an installation where it is possible to mount the assembly directly on the horizontal roof surface 16 about which a guard enclosure is required. As described above, the fastener pads 20 can be fastened to the roof surface using an adhesive, or alternatively or in addition, they can be secured as by fastenings 68, provided that such fastenings are designed to hold securely against tension forces. Since the base members 28 are now horizontal and the first post members 40 are vertical there is no need for the second post members 42 and the support members 56 are adjustably and releasibly mounted directly on the first post members 40. The adjustable length retainers (48–54) also are not required and the screw threaded rods 48 are simply allowed to rest against their respective support members 56; if considered necessary they can be retained positively by wiring them, or otherwise fastening them to the support members. As with the embodiment of FIG. 2 any outward acting force (arrow 64) applied to the guard rails will produce a corresponding anti-clockwise force moment at the surface engaging members 36 and their corresponding surface engagement areas, more properly now designated as the nearer (to the edge) surface engagement areas, pressing the members 36 toward the roof surface (arrow 66'), again maximizing tension forces at the fastener pads engagement areas. Similarly, any inward acting force (arrow 66) applied to the guard rails will produce corresponding clockwise force moments at the surface engaging members 38 and their corresponding surface engagement areas, more properly now designated as the further (from the edge) surface engagement areas, pressing the members 38 toward the roof surface (arrow 68'), again maximizing tension forces at the fastener pads engagement areas.

In this embodiment the guard rail retainer members 60 are intended to receive wood guard rails and comprise single open loops adapted to receive two standard building studs of nominal transverse dimensions 5 cm×10 cm (2 ins×4 ins) one over or under the other in overlapped arrangement. The telescoping arrangement of the base member 28 and extension 30 ensures that the surface engaging members 36 and 38 can be located at appropriate points on the surface 16. In such an application there is no roof edge contact with the support members 56 and both of the members 36 and 38 will be equally effective respectively with outward and inward acting forces. Means to hold the toe boards 15 in position, corresponding to the inverted-U brackets of the embodiment of FIG. 2, comprise L-shaped members 78 fastened, as for example by welding, to the respective first post members 40, the boards being retained between the vertical portions of the members and the adjacent ends of the base members 28.

Although FIGS. 1 and 2 illustrate an installation in which the scaffold assembly is attached solely to the vertical walls of the structure, and FIG. 3 illustrates an installation in which the assembly is attached solely to the horizontal roof surface to be guarded, and although an individual guard rail assembly member is attached either wholly to a wall surface or wholly to a roof surface, it will be understood that in some installations a part, or parts, of the guard enclosure may have the associated guard rail assembly members attached to a vertical wall or walls, while the remaining part or parts of the guard enclosure have the associated guard rail assembly members attached to the horizontal roof surface, whichever is preferred by the installer and/or is found to be most convenient.

Figure 4:
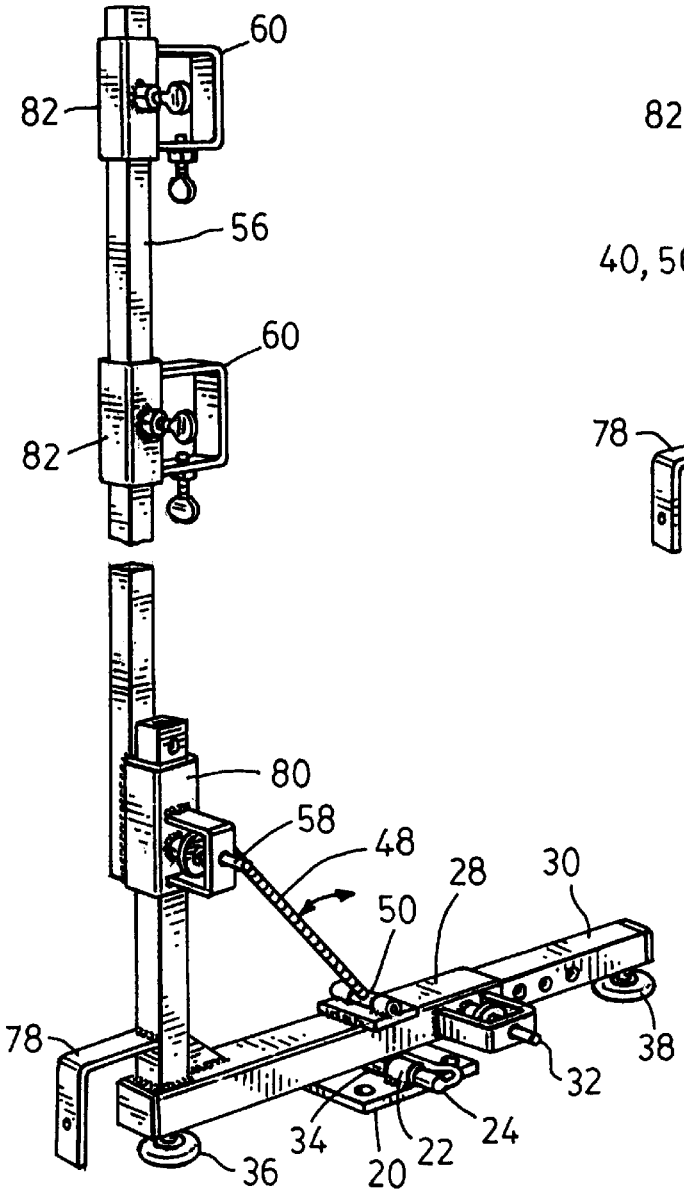

FIG. 4 illustrates an embodiment in which, for economy in material, and to facilitate manufacture, the support member 56 does not telescope directly onto the first post member 40, but instead is fastened to a sleeve 80 which slides on the post member and carries the latch 58, the sleeve consisting of a piece of the larger square cross-section tube, while the body of the member 56 consists of a piece of the less expensive, smaller, square cross-section tube. It is now economical also to mount the guard rail retainer members 60 on respective sleeves 82 consisting of larger size tube, and provided with respective clamp screws, so that the vertical positions of the guard rails can easily be adjusted independently of the mounting of the support member 56 on the post member 40. For many installations it may not be necessary for both of the surface engaing members 36 and 38 to be adjustable in length, and instead only one may be adjustable while the other is of fixed length corresponding at least approximately with the thickness of the separable connector.

Figure 5:
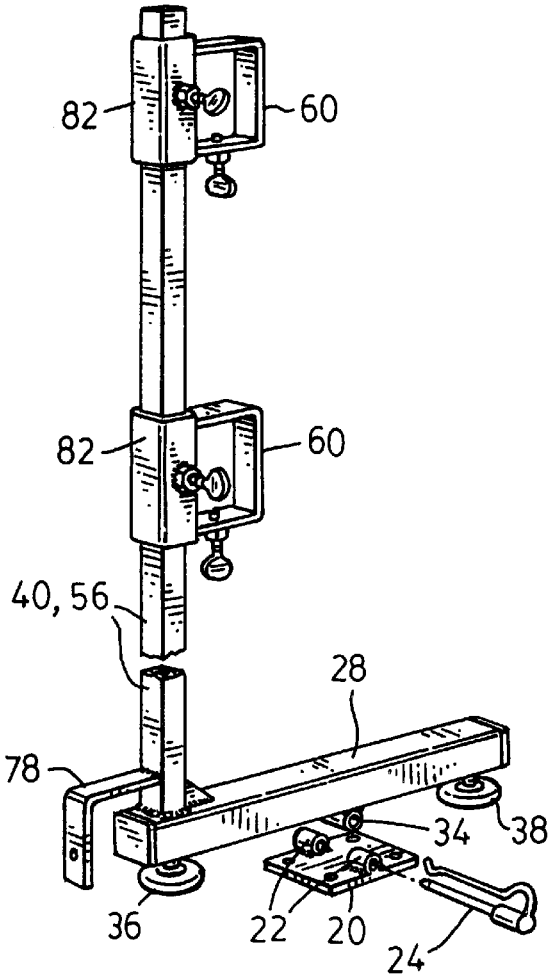
FIGS. 4 and 5 are perspective views of two guard rail assembly members that are respective further embodiments of the invention.

FIG. 5 illustrates an economically-manufactured embodiment intended solely for mounting on flat horizontal roof surfaces that are to be guarded, so that adaptation for use on vertical wall surfaces is not required. The base member 28 is fixed in length, while the first post member 40 is extended in length to function also as the guard rail support member 56, as is indicated by the dual reference 40,56, the member carrying two sleeve-mounted screw-clamped rail retainer members 60 whose height above the guarded roof surface can therefore readily be adjusted. Although in all of the embodiments described and illustrated the guard rail support members 56 extend truly vertically, in other embodiments, particularly those intended exclusively for flat roof surfaces, they can be inclined inward toward the enclosed work area, so that workers are kept further away from its edge.

I claim:

1. A guard rail scaffold assembly mounted around an above ground structure surface to be guarded by the assembly so as to protect an operator on the guarded surface against falling therefrom;

wherein:

the scaffold assembly comprises a plurality of transversely spaced vertically extending guard rail assembly members, a plurality of elongated horizontally extending guard rails each extending between and supported by a respective pair of immediately adjacent guard rail assembly members, and a plurality of fastener pads, one for each guard rail assembly member, each fastener pad comprising a respective pad separable connector part and being fastened to a fastener engagement area of a surface of the structure selected from a wall surface thereof and the guarded surface;

wherein:

each guard rail assembly member comprises an elongated base member comprising a base member separable connector part cooperatively engaged with a respective pad separable connector part to form therewith a pivotable separable connector having a pivot axis that extends horizontal and parallel to the selected structure surface, and about which pivot axis the base member is pivotable relative to the guarded surface when the scaffold assembly is installed around the guarded surface, the base member being pivotable about the pivot axis for adjustment of its direction of elongation so that the said direction can be made to extend at least approximately parallel to the fastener engagement area;

each guard rail assembly member also comprises an elongated guard rail support member having a corresponding direction of elongation and connected to the base member so as to extend above the guarded surface with the directions of elongation of the elongated base member and the guard rail support member in the same flat plane perpendicular to the guarded surface, the guard rail support member having at least one guard rail retainer member receiving a respective horizontally extending guard rail to retain it at a required distance above the guarded surface; and each guard rail assembly member further comprises two wall surface engaging members on the base member, both spaced from the pivot axis on opposite sides thereof and engaging respective correspondingly spaced engagement areas of the same selected structure surface, to thereby maintain the direction of elongation of the base member parallel to the fastener engagement area;

wherein:

the last-mentioned spaced engagement areas also constitute respective spaced pivot areas about which the base member is urged to pivot when it is subjected to a force acting respectively outward away from or inward toward the wall surface;

wherein:

an outward acting force applied to a guard rail urges the base member for pivoting movement at the corresponding pivot area away from the selected structure surface, thereby producing a corresponding pivoting force moment at the respective pivot area, and an inward acting force urges the base member for pivoting movement at the other corresponding pivot area away from the selected structure surface, thereby producing a corresponding pivoting force moment at the respective pivot area;

and wherein:

the force that is applied to the pivotal separable connector as the result of an inward or an outward force is thereby applied thereto as a maximum of tension force acting outward at least approximately perpendicularly to the fastener engagement area and as a minimum of peeling force acting parallel to the fastener engagement area.

2. A scaffold assembly as claimed in claim 1, wherein the elongated base member of each guard rail assembly member comprises an additional part telescoping therein for adjustment of its length and wherein one of the surface engaging members is mounted on the additional part.

3. A scaffold assembly as claimed in claim 1, wherein each guard rail assembly member comprises:

a first post member spaced from the pivot axis and extending from the elongated base member at least approximately at a right angle thereto so as to extend at least approximately at a right angle to the selected structure surface; and wherein the guard rail support member is releasibly mounted on the first post member so as to extend at least approximately at a right angle to the elongated base member and to the guarded surface.

4. A scaffold assembly as claimed in claim 3, wherein the first post member and the surface engaging member of each guard rail assembly member on the same side of the pivot axis are fastened to the respective elongated base member on opposite sides thereof immediately adjacent to one another.

5. A scaffold assembly as claimed in claim 3, wherein each guard rail assembly member comprises:

a second post member releasibly mounted on the first post member so as to extend at least approximately at a right angle thereto, and thereby extend at least approximately parallel to the elongated base member;

the guard rail support member being releasibly mounted on the second post member so as to also extend at least approximately parallel to the elongated base member.

6. A scaffold assembly as claimed in claim 5, wherein each guard rail assembly member comprises:

an adjustable length retainer member connected between the elongated base member and the second post member, spaced from and extending at least approximately parallel to the first post member, the retainer member being connected by a pivot to the base member and having at its end connected to the second post member means for adjustment of its length, shortening of its length urging the second post member toward the elongated base member.

7. A guard rail scaffold assembly as claimed in claim 1, wherein:

each fastener pad is fastened to a fastener engagement area of a wall surface of the structure and the elongated base member is disposed with its direction of elongation vertical;

wherein:

one of the two wall surface engaging members on the base member is disposed below the pivot axis and engages a respective lower engagement area of the same wall surface, and the other is disposed above the pivot axis and engages a respective upper engagement area of the same wall surface;

wherein:

the lower and upper engagement areas also constitute respective lower and upper pivot areas about which the base member is urged to pivot;

and wherein:

an outward acting force applied to a guard rail urges the base member for pivoting movement at the lower pivot area away from the wall surface, thereby producing a corresponding pivoting force moment at the lower pivot area, and an inward acting force urges the base member for pivoting movement at the upper pivot area away from the wall surface, thereby producing a corresponding pivoting force moment at the upper pivot area.

8. A scaffold assembly as claimed in claim 7, wherein the elongated base member of each guard rail assembly member comprises an additional part telescoping therein for adjustment of its length and wherein one of the surface engaging members is mounted on the additional part.

9. A scaffold assembly as claimed in claim 7, wherein each guard rail assembly member comprises:

a first post member extending from the elongated base member at least approximately at a right angle thereto so as to extend at least approximately at a right angle to the wall surface, the first post member being spaced from the pivot axis in the same direction as the wall surface engaging member that engages the lower engagement area; and wherein the guard rail support member is releasibly mounted on the first post member so as to extend at least approximately at a right angle to the elongated base member and to the guarded surface.

10. A scaffold assembly as claimed in claim 9, wherein the first post member and the wall surface engaging member of each guard rail assembly member on the same side of the pivot axis are fastened to the respective elongated base member on opposite sides thereof immediately adjacent to one another.

11. A scaffold assembly as claimed in claim 9, wherein each guard rail assembly member comprises:

a second post member releasibly mounted on the first post member so as to extend at least approximately at a right angle thereto, and thereby extend at least approximately parallel to the elongated base member;

the guard rail support member being releasibly mounted on the second post member so as to also extend at least approximately parallel to the elongated base member.

12. A scaffold assembly as claimed in claim 11, wherein each guard rail assembly member comprises:

an adjustable length retainer member connected between the elongated base member and the second post member, spaced from and extending at least approximately parallel to the first post member, the retainer member being connected by a pivot to the base member and having at its end connected to the second post member means for adjustment of its length, shortening of its length urging the second post member toward the elongated base member.

13. A guard rail scaffold assembly as claimed in claim 1, wherein:

each fastener pad is fastened to a fastener engagement area of a guarded surface of the structure and the elongated base member is disposed with its direction of elongation horizontal;

wherein:

one of the two guarded surface engaging members on the base member engages a respective nearer engagement area of the same guarded surface nearer to a junction of the wall surface and the guarded surface, and the other engages a respective further engagement area of the same guarded surface further from the junction of the wall surface and the guarded surface;

wherein:

the nearer and further engagement areas also constitute respective nearer and further pivot areas about which the base member is urged to pivot;

and wherein:

an outward acting force applied to a guard rail urges the base member for pivoting movement at the nearer pivot area away from the guarded surface, thereby producing a corresponding pivoting force moment at the nearer pivot area, and an inward acting force applied to the guard rail urges the base member for pivoting movement at the further pivot area away from the guarded surface, thereby producing a corresponding pivoting force moment at the nearer pivot area.

14. A scaffold assembly as claimed in claim 13, wherein the elongated base member of each guard rail assembly member comprises an additional part telescoping therein for adjustment of its length and wherein the surface engaging member that engages the further engagement area is mounted on the additional part.

15. A scaffold assembly as claimed in claim 13, wherein each guard rail assembly member comprises:

a first post member extending from the elongated base member at least approximately at a right angle thereto so as to extend at least approximately at a right angle to the guarded surface, the first post member being spaced from the pivot axis in the same direction as the surface engaging member that engages the nearer engagement area; and wherein the guard rail support member is releasably mounted on the first post member so as to extend at least approximately at a right angle to the elongated base member and to the guarded surface.

16. A scaffold assembly as claimed in claim 13, wherein the first post member and the surface engaging member of each guard rail assembly member that engages the nearer engagement area are fastened to the respective elongated base member on opposite sides thereof immediately adjacent to one another.

17. A guard rail assembly member for employment in a guard rail scaffold assembly for mounting around an above ground structure surface to be guarded so as to protect an operator on the guarded surface against falling therefrom;

wherein:

such a scaffold assembly when installed comprises a plurality of transversely spaced vertically extending guard rail assembly members, a plurality of elongated horizontally extending guard rails each extending between and supported by a respective pair of immediately adjacent guard rail assembly members, and a plurality of fastener pads, one for each guard rail assembly member, each fastener pad comprising a respective pad separable connector part that when the guard rail scaffold assembly is installed on the structure is adapted to be fastened to a fastener engagement area of a structure surface selected from a wall surface thereof and the guarded surface;

wherein:

the guard rail assembly member comprises a vertically extending elongated base member comprising a base member separable connector part for cooperative engagement with a respective pad separable connector part to form therewith a pivotable separable connector having a pivot axis that when the scaffold assembly is installed will extend horizontal and parallel to the structure surface fastener engagement area to which the respective fastener pad is fastened, and about which when the scaffold assembly is installed the base member will be pivotable relative to the guarded surface, the base member also being pivotable about the pivot axis for adjustment of its direction of elongation so that the said direction can be made to extend at least approximately parallel to the fastener engagement area;

the guard rail assembly member also comprises an elongated guard rail support member having a corresponding direction of elongation and connected to the base member so as to extend when the scaffold assembly is installed above the guarded surface with the directions of elongation of the elongated base member and the guard rail support member in the same flat plane which will extend perpendicular to the guarded surface, the guard rail support member having at least one guard rail retainer member adapted to receive a respective horizontally extending guard rail to retain it at a required distance above the guarded surface; and the guard rail assembly member further comprises two wall surface engaging members on the elongated base member both spaced from the pivot axis on opposite sides thereof and adapted when the scaffold assembly is installed to engage respective correspondingly spaced engagement areas of the same selected structure surface for maintaining the direction of elongation of the base member parallel to the fastener engagement area;

wherein:

the last-mentioned spaced engagement areas will also constitute respective spaced pivot areas about which the base member will be urged to pivot when a guard rail that the guard rail assembly member supports is subjected to a force acting respectively outward away from or inward toward the wall surface;

wherein:

an outward force applied to such a guard rail will urge the base member for pivoting movement at the corresponding pivot area away from the selected structure surface to which the elongated base member is fastened, thereby producing a corresponding pivoting force moment at the respective pivot area, and an inward force will urge the elongated base member for pivoting movement at the respective pivot area away from the selected structure surface, thereby producing a corresponding pivoting force moment at the respective pivot area;

and wherein:

the force that will be applied to the pivotal separable connector as the result of an inward or an outward force will thereby be applied thereto as a maximum of tension force acting outward at least approximately perpendicularly to the fastener engagement area and as a minimum of peeling force acting parallel to the fastener engagement area.

18. An assembly member as claimed in claim 17, wherein the elongated base member comprises an additional part telescoping therein for adjustment of its length and wherein one of the surface engaging members is mounted on the additional part.

19. An assembly member as claimed in claim 17, and comprising:

a first post member spaced from the pivot axis and extending from the elongated base member at least approximately at a right angle thereto; and wherein the guard rail support member is releasibly mounted on the first post member so as to extend at least approximately at a right angle to the elongated base member.

20. An assembly member as claimed in claim 19, wherein the first post member and the surface engaging member on the same side of the pivot axis are fastened to the respective elongated base member on opposite sides thereof immediately adjacent to one another.

21. An assembly member as claimed in claim 19, wherein the guard rail support member is releasibly mounted on the first post member for movement along its length.

22. An assembly member as claimed in claim 19, and comprising:

a second post member releasibly mounted on the first post member so as to extend at least approximately at a right angle thereto, and thereby extend at least approximately parallel to the elongated base member;

the guard rail support member being releasibly mounted on the second post member so as to also extend at least approximately parallel to the elongated base member.

23. An assembly member as claimed in claim 22, and comprising an adjustable length retainer member connected between the elongated base member and the second post member, spaced from and extending at least approximately parallel to the first post member, the retainer member being connected by a pivot to the base member and having at its end connected to the second post member means for adjustment of its length, shortening of its length urging the second post member toward the elongated base member.

* * * * *